US005657031A

United States Patent [19]

Anderson et al.

[11] Patent Number: 5,657,031

[45] Date of Patent: Aug. 12, 1997

[54] EARTH STATION ANTENNA SYSTEM

[76] Inventors: Fredrick C. Anderson, 5422 Drover Dr., San Diego, Calif. 92115; Paul Gaske, 4313 Haverford Dr., Rockville, Md. 20853; Nicholas Moldovan, 105 Quail Dr., Newton, N.C. 28658; Peter L. Gardner, 2016 19th Ave. Cr. NE, Hickory, N.C. 28601; Chang S. Kim, 4225 Hemingway St., Hickory, N.C. 28601

[21] Appl. No.: 637,567

[22] Filed: Jan. 7, 1991

[51] Int. Cl.[6] ..... H01Q 3/00

[52] U.S. Cl. ..... 343/757; 343/761; 343/765; 343/882

[58] Field of Search ..... 343/757, 878, 343/880, 882, 894, 763, 765, 766, 760, 840

[56] References Cited

U.S. PATENT DOCUMENTS

| | | | |
|---|---|---|---|
| 3,028,595 | 4/1962 | Cole et al. | 343/882 |
| 3,028,596 | 4/1962 | Cole et al. | 343/882 |
| 3,852,763 | 12/1974 | Kreufel, Jr. et al. | 343/761 |
| 4,644,365 | 2/1987 | Horning | 343/757 |
| 4,689,635 | 8/1987 | Haupt | 343/894 |
| 4,819,007 | 4/1989 | Tezcan | 343/882 |
| 4,875,052 | 10/1989 | Anderson et al. | 343/882 |

FOREIGN PATENT DOCUMENTS

| | | | |
|---|---|---|---|
| 0257001 | 11/1986 | Japan | H01Q 19/100 |
| 2062357 | 5/1981 | United Kingdom | 343/765 |
| 2120856 | 12/1983 | United Kingdom | 343/765 |

*Primary Examiner*—Donald T. Hajec
*Assistant Examiner*—Tan Ho
*Attorney, Agent, or Firm*—Pollock, Vande Sande & Priddy

[57] ABSTRACT

A small aperture satellite ground station communications antenna is disclosed. A rectangular section of a curved parabolic reflector is provided having first and second rectangular dimensions. An azimuth elevation pedestal for positioning the reflector is provided such that the antenna bore sight is aligned with a geostationary satellite. The reflector is supported by the pedestal to permit rotation of the reflector about a third polarization axis for the antenna. The rotation along the polarization axis permits the reflector to be optimally positioned such that its long dimension is aligned with an orbital arc of a geostationary satellite. Angle scales are provided on all three axes to facilitate repositioning to other satellites based on an initial satellite location, which serves as a reference for the scales.

7 Claims, 4 Drawing Sheets

EARTH STATION ANTENNA SYSTEM

The present invention relates to earth station antenna systems for communicating with geostationary satellite transponders. Specifically, a small aperture antenna system is provided having a reduced beam width aligned with the orbital arc or Clark belt of geostationary satellites.

Geostationary satellite transponders have provided nationwide communication links using relatively little power while providing a large communication bandwidth. These satellite transponders are in a common orbit 23,300 miles above the earth. The satellites have a common latitude on the equator and are spaced apart longitudinally in the orbit by only 2°–3°.

When communicating with these satellites care must be taken not to illuminate more than one satellite with the uplink radio frequency energy and, conversely, not to receive interfering signals from adjacent satellites located along the Clark belt. FCC regulations require that a narrow beam width antenna be employed to narrowly focus transmit energy on the satellites. The conventional earth station antenna utilizes a parabolic reflector which produces a concentrated symmetrical radiation pattern with a beam width parallel to and perpendicular to the Clark belt, with most of the radio frequency energy beam confined to within a few degrees of the antenna bore sight axis. The requirement for a transmit radiation beam width which is sufficiently narrow to avoid interference with adjacent satellites, places a limit on the size of the antenna needed to achieve this result. At a given frequency, the smaller the antenna diameter, the wider the beam width and the lower the antenna gain. It is possible to design a satellite system that can utilize a lower gain, and hence too broad a beam width antenna to meet FCC antenna pattern restrictions in the geostationary arc.

The cost of earth stations is directly related to the required antenna size. Any reduction in antenna aperture size correspondingly reduces the weight of the antenna and, very importantly, the wind forces on the antenna and mounting structure, which in turn reduces the size of the required mast and supporting foundation structure for the antenna, and the manufacturing, shipping and installation costs for the antenna. A reduction in aperture size may be realized if it is recognized that it is only in one direction that the onerous beam width requirements must be observed. This direction corresponds to the direction of the satellite geostationary orbital arc, i.e., Clark belt. The direction perpendicular to the satellite orbit contains no satellite transponders which can be interfered with, nor at Ku band frequencies are any terrestrial facilities likely to be interfered with if the beam width requirements are relaxed in this direction. The present invention provides an antenna system which will have a reduced size and yet provide a non-symmetric beam width sufficiently narrow to avoid interference with adjacent satellites, and a wider beam width perpendicular to the Clark belt, where there are no geostationary satellites.

SUMMARY OF THE INVENTION

It is an object of this invention to provide an earth station antenna system having a small antenna aperture which does not produce radio frequency interference with adjacent satellite transponders, or receive interference from adjacent satellite transponders.

It is a particular object of this invention to provide an earth station antenna system having an antenna aperture which is reduced in one dimension and provides a narrow beam width in an orthogonal directional sufficient to avoid radio frequency interference with adjacent satellites.

It is a more specific object of this invention to provide an antenna system having an antenna with a rectangular aperture, narrow in one direction orthogonal to the orbit of a geostationary satellite, and longer in an orthogonal direction aligned with a satellite orbit.

These and other objects are provided by an earth station antenna system in accordance with the invention. An antenna having an aperture dimension which is larger in one direction than the dimension in an orthogonal direction is oriented in three rotational axes coordinate directions, such that the narrower beam width produced along the longer dimension is aligned with the orbital arc of a geostationary satellite. The narrower aperture dimension having a wider beam width is aligned orthogonal to the orbital arc.

In carrying out the invention, a pedestal is provided for azimuth and elevation positioning of the antenna. Additionally, the antenna is supported on the pedestal such that it can be rotated about a polarization axis coincident with the antenna bore sight axis, permitting alignment of the antenna's longer aperture dimension with the orbital arc of a geostationary satellite.

In accordance with a preferred embodiment of the invention, an antenna having a rectangular aperture is supported on a polarization platform. The polarization platform is connected to the elevation platform of an azimuth-elevation pedestal so that it may be rotated about an axis coincident with the antenna bore sight axis. A position indicator is provided on the polarization platform which indicates the relative angular inclination of the antenna rectangular aperture with respect to a reference position. A locking bolt is provided to lock the polarization platform to the elevation platform in an affixed position once a desired orientation of the antenna aperture is achieved.

The foregoing system permits a reduction in overall aperture size of the antenna because beam width control is relaxed in the direction orthogonal to the satellite geostationary orbital arc. The antenna aperture size in the direction of the arc is sufficiently large to permit the required gain and narrow beam width to be obtained which will avoid interference with an adjacent satellite.

DESCRIPTION OF THE PREFERRED EMBODIMENT

Figure 1:
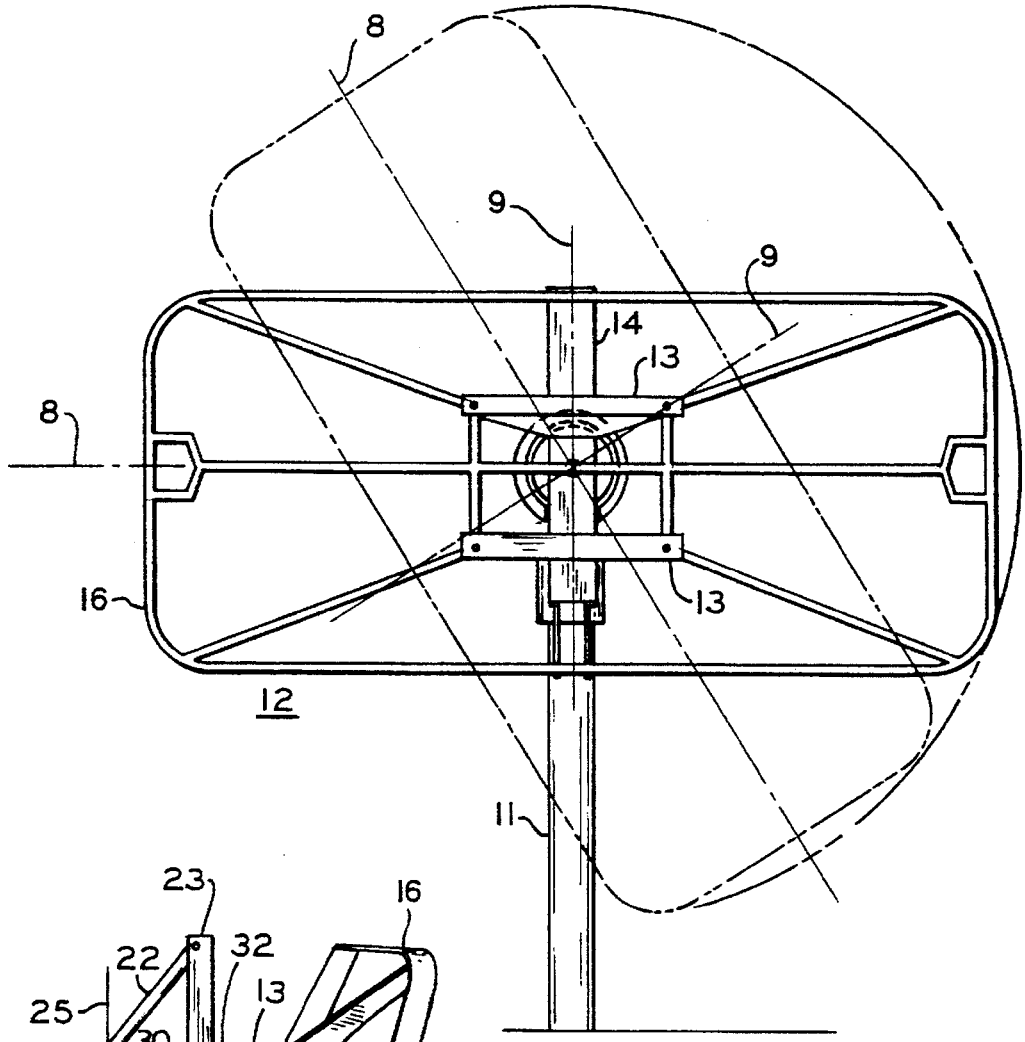
FIG. 1 is a front plan view illustrating how the polarization of a rectangular offset apertured antenna may be rotated about the antenna bore sight axis.

Referring now to FIG. 1, there is shown a reflector 12 having a rectangular aperture. The reflector 12 is shown (for clarity) without the reflecting skin, revealing the backing structure 16 for supporting a reflecting skin. The reflector 12 represents a rectangular cross-section of a parabolic surface, permitting formation of a beam of electromagnetic energy, having the beam width of a parabolic reflector along the major axis 8 of the rectangular segment. Along the minor axis 9 of the segment, a wider beam width of a parabolic reflector is obtained given the smaller dimension over which the curvature of the reflector is disposed.

The antenna reflector 12 backing structure 16 is supported by an azimuth elevation pedestal connected on the mast 11. The backing structure 16 is connected by two backing structure supports 13 to a polarization platform 14. The polarization platform 14 permits rotation of the entire reflector assembly 12 so that the major axis 8 of the reflector can be aligned with an orbital arc of a geostationary satellite.

Figure 2:
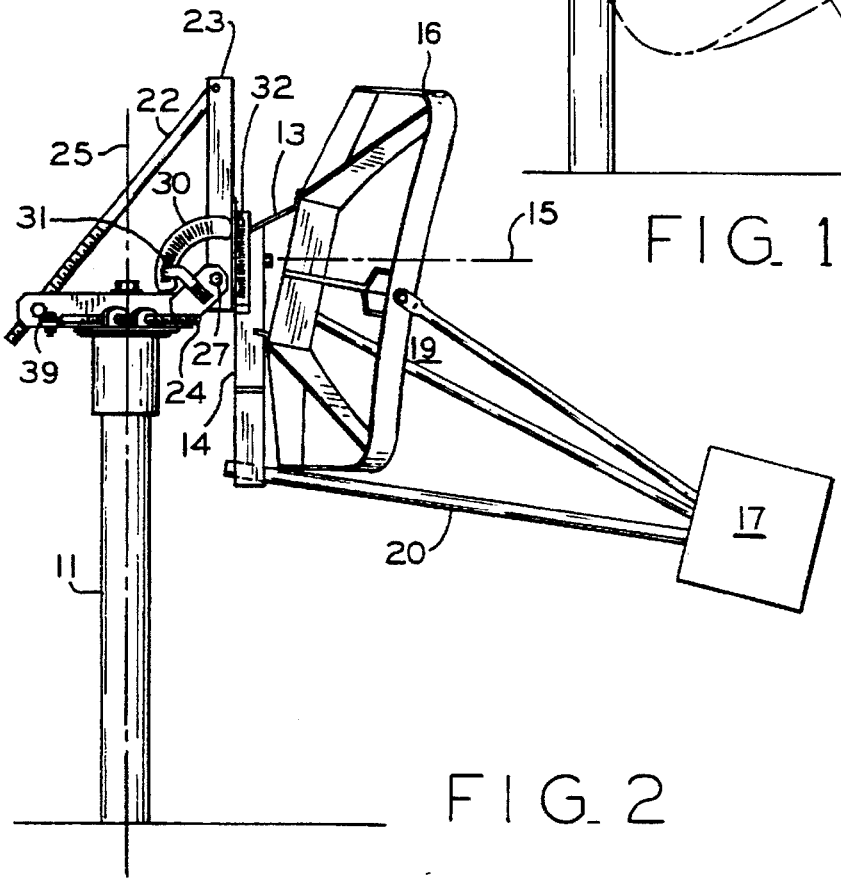
FIG. 2 is a side view of the antenna system of FIG. 1 with the feeds and feed support axes included.

FIG. 2 is a side view of the antenna system of FIG. 1, illustrating, in addition to the backing structure 16, a tripod feed support consisting of a pair of feed arms 19 and feed support 20. Those skilled in antenna technology will recognize that the feed supports 19 and 20 are positioned to accommodate an offset feed 17, permitting an efficient illumination of the rectangular reflector 12. The feedhorn aperture is designed to produce a rectangular beam width to efficiently illuminate the rectangular reflector. The resulting secondary radiation pattern from the reflector 12 having a rectangular aperture and non-symmetrical beam pattern is centered along an antenna bore sight 15. The feedhorn designed to have the proper antenna radiation pattern to efficiently illuminate the reflector 12 is located at the reflector focal point, and has the required offset angle with respect to the normal vertex to focal point reference line.

Also shown in FIG. 2 is an elevation control rod 22 which positions the elevation platform 23 about an axis 27. An elevation scale 30 and indicator 31 are provided for indicating the relative elevation position of the pedestal. Further, an azimuth platform 39 is controlled by a similar bar 24 for positioning the azimuth platform 39 about an axis 25 and also includes an azimuth scale similar to the elevation scale and indicator not shown.

The key feature of these scales is that, once a known satellite is found and verified as the correct satellite, the point and/or scale can be field-adjusted at the time of installation to the calculated elevation and azimuth angles, as calculated from knowing the earth station's latitude and longitude. This effectively adjusts the scales so that a secondary satellite can be easily located in case of failure of the primary satellite, using relatively unskilled personnel, by calculating the new angle to the second satellite and moving the antenna to the new angular positions.

Figure 4:
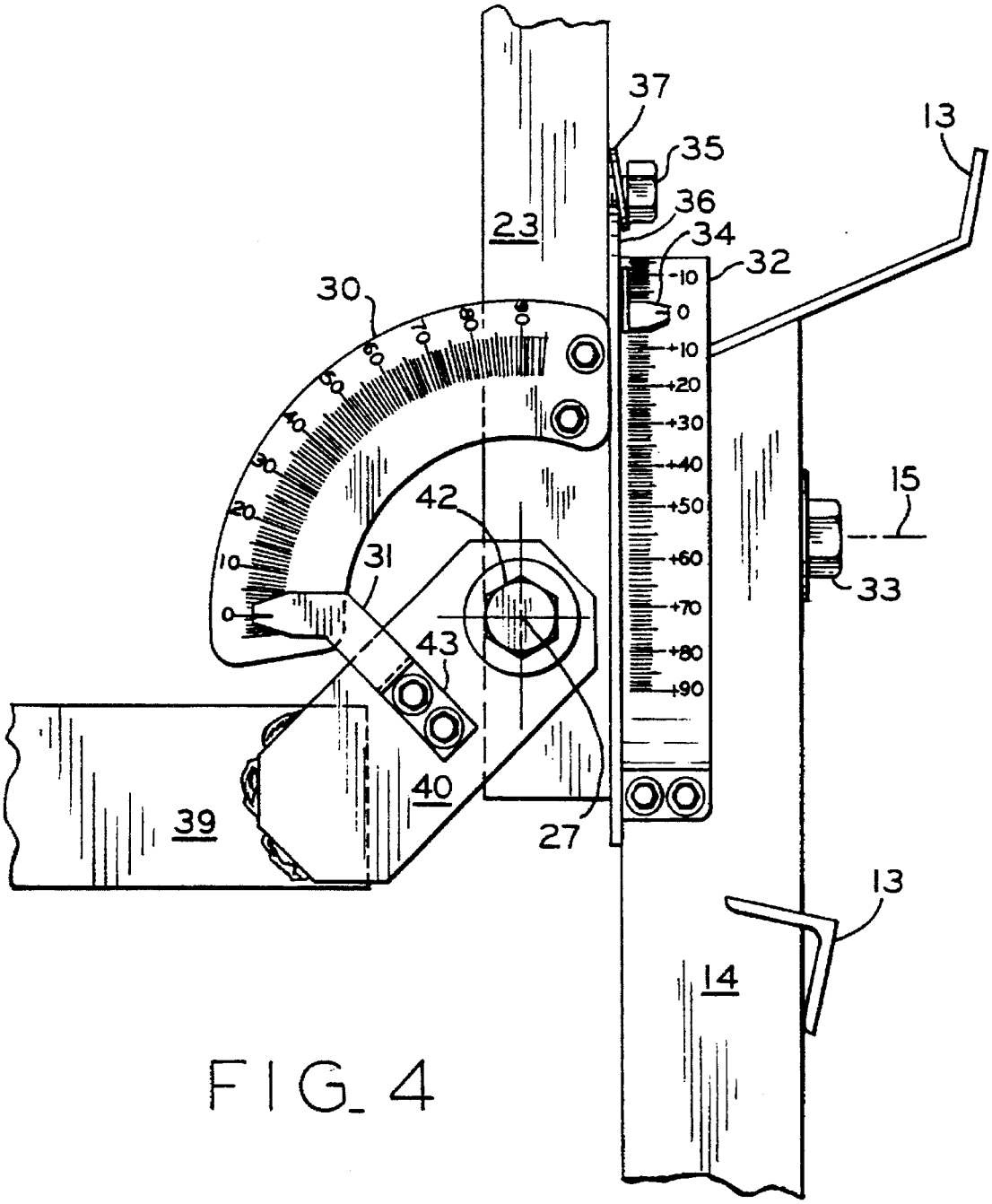
FIG. 4 illustrates the polarization platform which permits coupling of the antenna to an elevation azimuth pedestal.

The elevation scale 30 and elevation indicator 31 shown in FIGS. 2 and 4 indicate the elevation angle to the satellite. After a known satellite is found, the two pointer screws 43 are loosened and the pointer adjusted to the exact calculated elevation angle to the verified satellite. This adjustment in effect calibrates the elevation scale so that the scale and pointer can be used to easily adjust the elevation look angle by lengthening or shortening the elevation rod 22 adjustments, to the calculated elevation angle of any backup satellite in the geostationary orbital arc.

Figure 5:
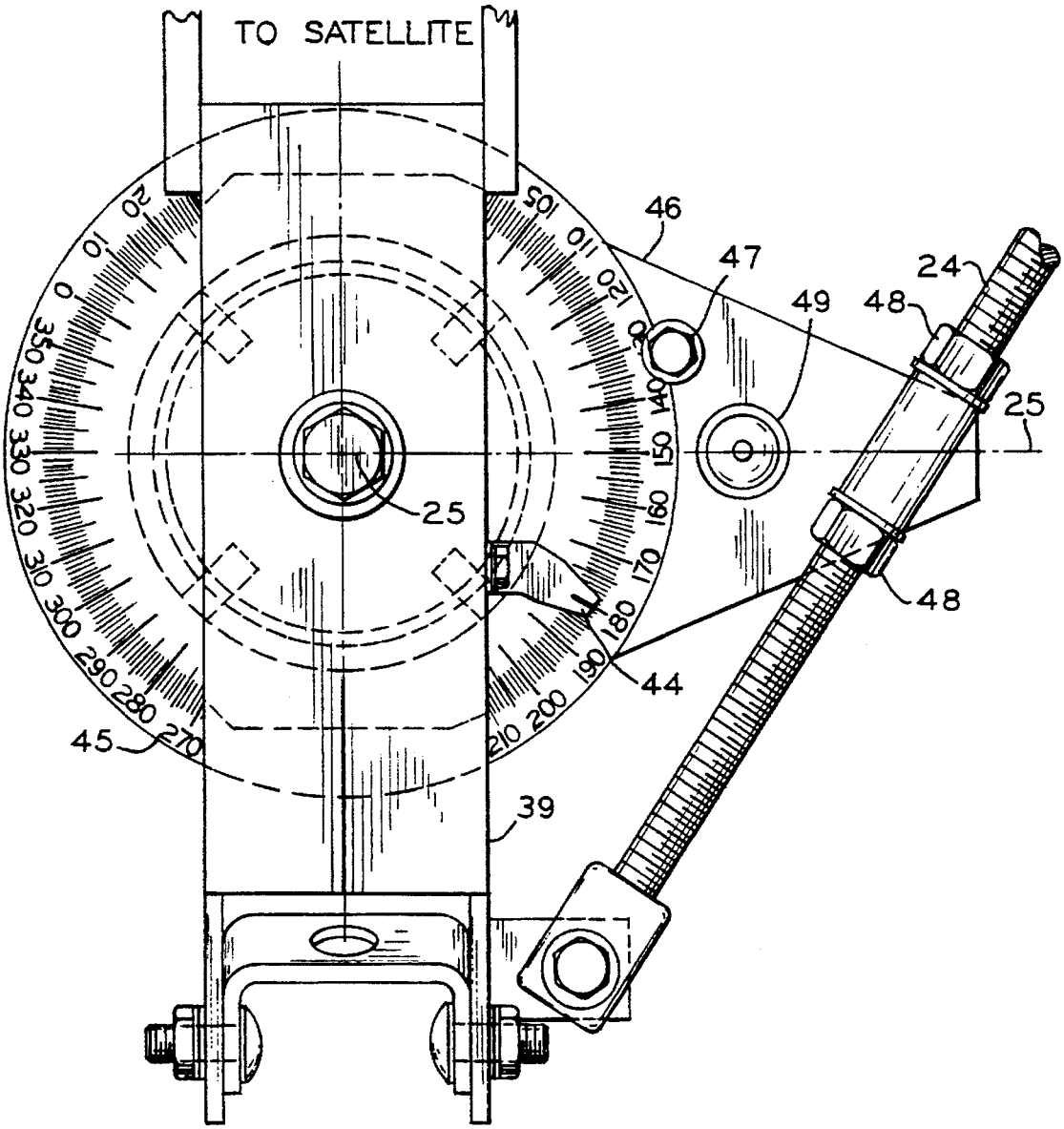
FIG. 5 is a top view of the azimuth platform showing how the azimuth pointing position may be conveniently represented.

An adjustable circular azimuth scale 45, in FIG. 5, is located on top of the canister 46 and locked down by a screw 47. An azimuth indicator 44 is attached to the positioner 39. As the positioner is rotated around the azimuth axis 25 the azimuth indicator points to the different azimuth scale angles (0 to 360 degrees). After a known satellite is found, the screw 47 is loosened and the circular azimuth scale 45 rotated until the exact calculated azimuth angle to the known satellite is indicated by the azimuth indicator. The screw is then tightened to lock the azimuth scale in this position. This, in effect, calibrates the scale so that the scale pointer can be used to easily point the antenna to the calculated azimuth angle of any backup satellite in the realizable geostationary orbital arc from this particular site location. To lock the antenna in this position, the azimuth locking nuts 48 are tightened on rod 24. A bubble level 49 is provided to aid in getting the canister level so that changes in azimuth do not change the elevation angle.

The foregoing antenna structure permits positioning of the reflector 12 in elevation and azimuth such that the antenna bore sight axis can be directly positioned on an orbiting satellite. Further, the polarization platform 14 permits rotation of the antenna reflector about the antenna bore sight axis 15 such that the major dimension for the reflector 12 may be aligned with the orbital arc of a geostationary satellite, i.e., the Clark belt.

The benefits of this polarization platform positioning mechanism is an optimization of the antenna gain and beam width along the orbital arc direction in order that the required adjacent satellite separation is maintained, wherein signals originating from the antenna reflector 12 effectively illuminate only one satellite within the orbital arc. It will be recalled that geostationary satellites are positioned within an arc such that they differ in longitude by only 2°–3°, and occupy the same latitude (90°—on the equator) above the earth's surface.

The narrower dimension of the reflector 12 is orthogonal to the orbital arc and produces a wider beam width signal which, as has been demonstrated, is of no consequence since no geostationary satellites lie outside the given latitude of the geostationary satellites. Further, at the Ku band frequencies which are used in these communication satellite applications, no terrestrial installations are in operation which would be interfered with by any spillover from the reflector along the orthogonal direction.

Figure 3:
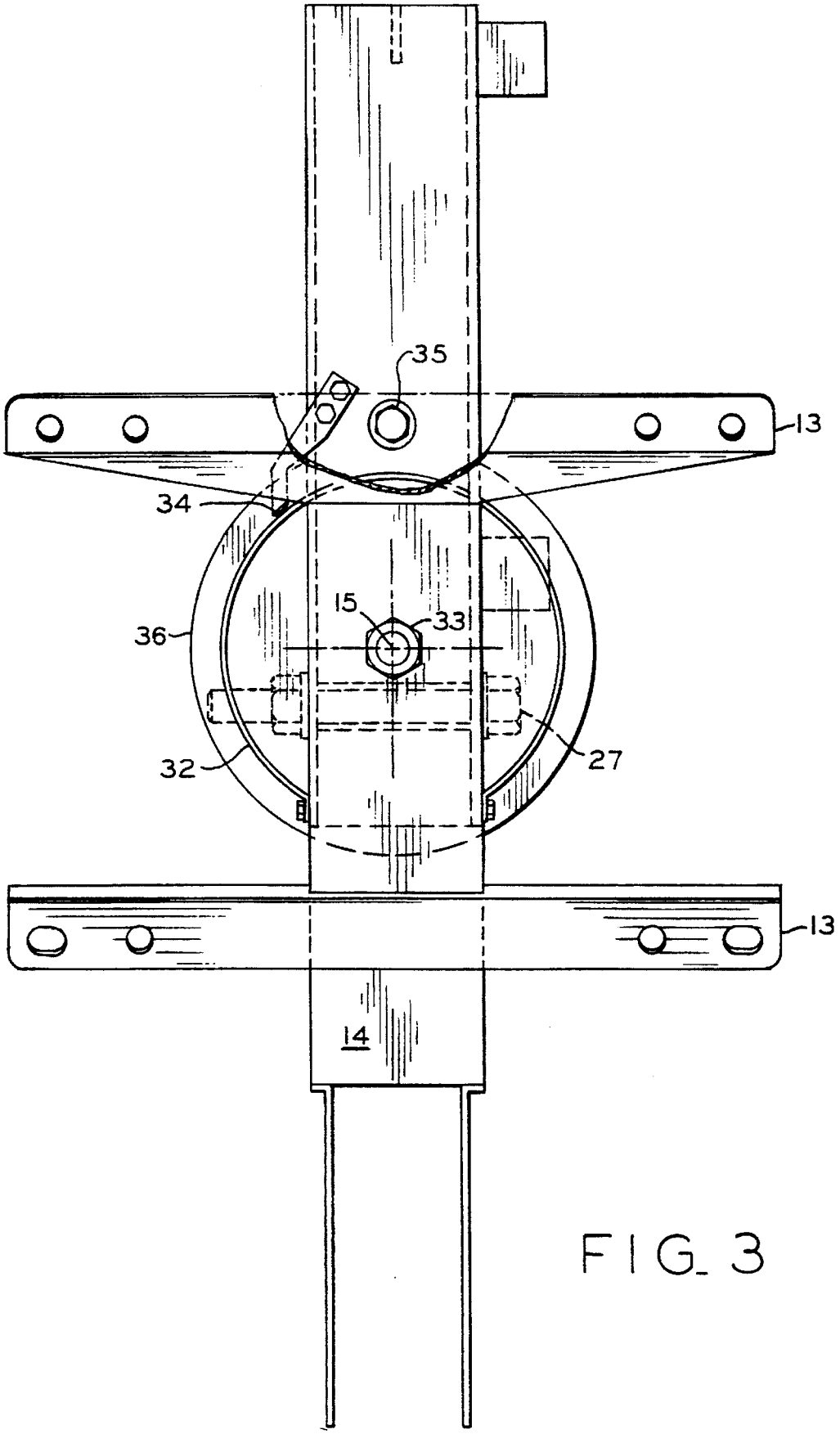
FIG. 3 is a back view of the polarization platform 14 connected to the antenna backing structure supports 13 and elevation platform 23 (shown in FIGS. 1 and 4).

FIGS. 3 and 4 illustrate in greater detail the polarization platform 14 connected to the elevation platform 23. The two platforms are connected by a bolt 33 extending through the platforms, along an axis 15 which is coincident with the antenna bore sight axis, the direction to the satellite and is the polarization rotation axis. Relative rotation is permitted via the bolt 33 between the polarization platform 14 and elevation platform 23. A locking screw 35 is shown which is received in a threaded hole of the elevation platform 23. The locking bolt 35 may be tightened against a locking plate 36, integral with the polarization platform 14. Once a desired orientation of the major axis of the antenna reflector 12 is achieved, the locking bolt 35 will maintain the polarization platform fixed with respect to the elevation platform 23.

Also shown in FIGS. 3 and 4 are a polarization scale 32 and corresponding polarization indicator 34. The polarization scale and polarization indicator are designed and factory aligned to permit the polarization platform to be conveniently referenced with respect to the polarization indicator 34, to indicate the precise polarization angle in degrees. Thus, the pedestal may be accurately positioned with respect to polarization, by resorting to the polarization scale 32 and polarization indicator 34, along with the elevation scale 30.

The backing structure supports 13 are shown connected at an angle to the polarization platform to permit the antenna bore sight axis resulting from an offset feed to lie along the line 15, coincident with the polarization rotation axis.

As is shown in FIGS. 3 and 4, the orientation of the polarization platform is easily accomplished by loosening the locking bolt 35 and rotating the entire antenna reflector 12 about the rotation support bolt 33. In the event that it is desired to change the positioning of the antenna to access a second geostationary satellite lying within the orbital arc, it is possible to reposition the antenna in azimuth, elevation and polarization by supplying the requisite angular coordinates identifying that satellite for the position on the earth which is occupied by the earth station. In this way, it is not necessary to send experienced installation personnel to the site to provide repositioning of the antenna along all three coordinates.

Thus, it is clear that by incorporating the additional polarization platform to the pedestal, an efficiency is achieved in obtaining a smaller aperture antenna and the reduced costs associated therewith. The smaller aperture antenna system preserves the beam width requirements for avoiding interference with an adjacent satellite. Those skilled in the art will recognize yet other embodiments described more particularly by the claims which follow.

What is claimed is:

1. A small aperture satellite communications antenna comprising:

a reflector and antenna feed forming an antenna having a substantially rectangular aperture longer in one dimension than in another dimension, said antenna having a beam width centered about a bore sight axis, said beam width along the longer dimension being narrower than the beam width along said another dimension to distinguish signals from one satellite lying along a common orbital arc from signals of other satellites along said arc;

an azimuth-elevation pedestal for pointing said bore sight axis associated with said antenna at said one geostationary satellite lying along said common orbital arc with a plurality of other geostationary satellites; and, a polarization support means for rotatably supporting said antenna on said azimuth elevation pedestal, said polarization support means providing rotational motion of said reflector and antenna feed to align said longer dimension of said reflector and antenna feed into coincidence with said orbital arc of a geostationary satellite, whereby said narrower beam width is aligned with said orbital arc to receive said one satellite signal.

2. A small aperture satellite communication antenna of claim 1 further comprising a polarization indicator for indicating relative angular position of said longer dimension with respect to a reference position.

3. The small aperture satellite communications antenna of claim 1, wherein said reflector and antenna feed comprise:

a reflector having a rectangular aperture; and, an offset feed for illuminating said aperture.

4. A small aperture satellite communication antenna comprising:

(a) a rectangular section of a curved reflector having first and second rectangular dimensions;

(b) a feed for illuminating said reflector supported on said curved reflector to form a secondary radio frequency energy beam concentrated by said rectangular section of said curved reflector, said beam having a narrower beamwidth along said first dimension than said second dimension;

(c) an azimuth elevation pedestal for positioning said reflector so that the radiation pattern of said illuminated reflector is aligned with one geostationary satellite lying along a common orbit with a plurality of other geostationary satellites; and, (d) a reflector support assembly connected to the rear side of said rectangular section, said assembly including means for rotating said reflector about a bore sight axis of said reflector secondary radio frequency beam to position said first dimension coincident with said geostationary satellite orbit, whereby said narrower beamwidth receives said one satellite signal.

5. The communication antenna of claim 4 wherein said reflector support assembly comprises a backing structure connected to a polarization platform which rotates about a rotational axis perpendicular to an elevation platform of said azimuth elevation pedestal, said backing structure supporting said reflector so that a central axis of said reflector is at an angle to said rotational axis.

6. The small aperture satellite communications antenna of claim 4 comprising an indicator means for identifying the angular position of one of said reflector rectangular dimensions with respect to a reference position.

7. The small aperture communication antenna of claim 4 wherein said feed and curved reflector constitute an offset feed antenna.

* * * * *